US005949009A

United States Patent [19]

Chen

[11] Patent Number: 5,949,009

[45] Date of Patent: Sep. 7, 1999

[54] ADJUSTABLE TOM-TOM HOLDER

[75] Inventor: Erh-Chiang Chen, Taichung Hsien, Taiwan

[73] Assignee: TAY-E Co., Ltd., Taichung Hsien, Taiwan

[21] Appl. No.: 09/127,786

[22] Filed: Aug. 3, 1998

[51] Int. Cl.[6] ..... G10D 13/02

[52] U.S. Cl. ..... 84/421; 84/422.1; 84/422.2; 84/422.3

[58] Field of Search ..... 84/421, 422.1, 84/422.2, 422.3

[56] References Cited

U.S. PATENT DOCUMENTS 4,141,272 2/1979 Yanagisawa ..... 84/421

5,660,364 8/1997 Hsieh ..... 248/309.1

5,804,747 9/1998 Chen ..... 84/327

*Primary Examiner*—William M. Shoop, Jr.

*Assistant Examiner*—Kim Lockett

*Attorney, Agent, or Firm*—Bacon & Thomas, PLLC

[57] ABSTRACT

An adjustable tom-tom holder includes a mounting base fixedly fastened to the shell of a base drum, a holder block turned about an annular coupling block at the mounting base, the holder block having a longitudinally extended V-groove at the top, a support bar sliding in the V-groove, the support bar having an upright supporting rod for holding side drums, and a holding-down plate fastened to the holder block by screws to hold down the support bar in the desired position.

2 Claims, 6 Drawing Sheets

ADJUSTABLE TOM-TOM HOLDER

BACKGROUND OF THE INVENTION

The present invention relates to a tom-tom holder, and more particularly to an adjustable tom-tom holder which can be conveniently adjusted to move the carried side drums horizontally to the desired angle and position.

In a drum set, aerial tom-toms are mounted a tom-tom holder at the shell of the base drum (see FIG. 1). The tom-tom holder, as shown in FIG. 2, is comprised of a mounting base fixedly fastened to the shell of the base drum by screws, a holder block raised from the mounting base, the holder block having two vertical coupling holes at the top and two horizontal screw holes respectively perpendicularly extended from the vertical coupling holes to the periphery of the holder block, two supporting rods respectively mounted in the vertical coupling holes for holding a side drum each, and two tightening up screws respectively threaded into the screw holes to secure the supporting rods in place. When the tom-tom holder is fastened to the shell of the base drum, it cannot be adjusted to change the position of the supporting rods forwards or backwards relative to the head of the base drum or the player. In order to fit the player, the tom-tom holder must be custom-made. However, a tom-tom holder made to order is expensive.

SUMMARY OF THE INVENTION

It is the main object of the present invention to provide an adjustable tom-tom holder which can be adjusted to change the position and angle of the tom-tom support bar thereof horizontally, enabling the tom-toms to be adjusted to the desired angular position. According to one aspect of the invention, the adjustable tom-tom holder comprises a mounting base fixedly fastened to the shell of a base drum, a holder block turned about an annular coupling block at the mounting base, the holder block having a longitudinally extended V-groove at the top, a support bar sliding in the V-groove, the support bar having an upright supporting rod for holding side drums, and a holding-down plate fastened to the holder block to hold down the support bar in the desired position. According to another aspect of the present invention, a guide block is slidably mounted on the holder block and retained in contact with the tapered outside wall of the annular coupling block to secure the holder block to the annular coupling block.

DETAILED DESCRIPTION OF THE PREFERRED EMBODIMENT

Figure 1:
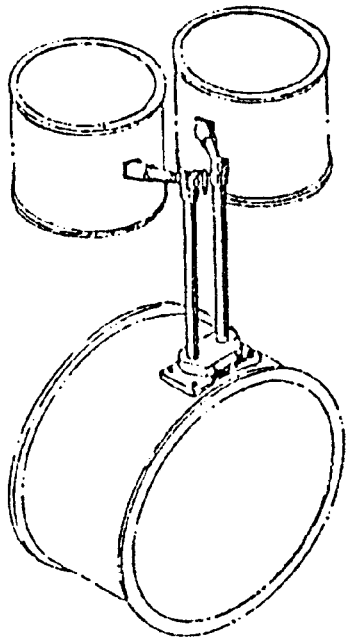
Fig. 1 PRIOR ART
FIG. 1 is shows tom-toms carried on a tom-tom holder at the shell of a base drum according to the prior art.
Figure 2:
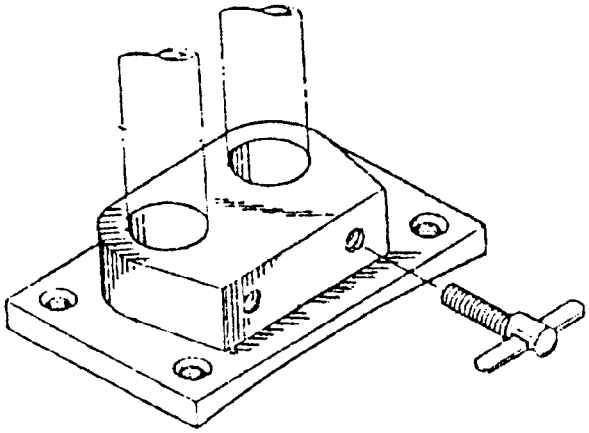
Fig. 2 PRIOR ART
FIG. 2 is an exploded view in an enlarged scale of the tom-tom holder shown in FIG. 1.
Figure 3:
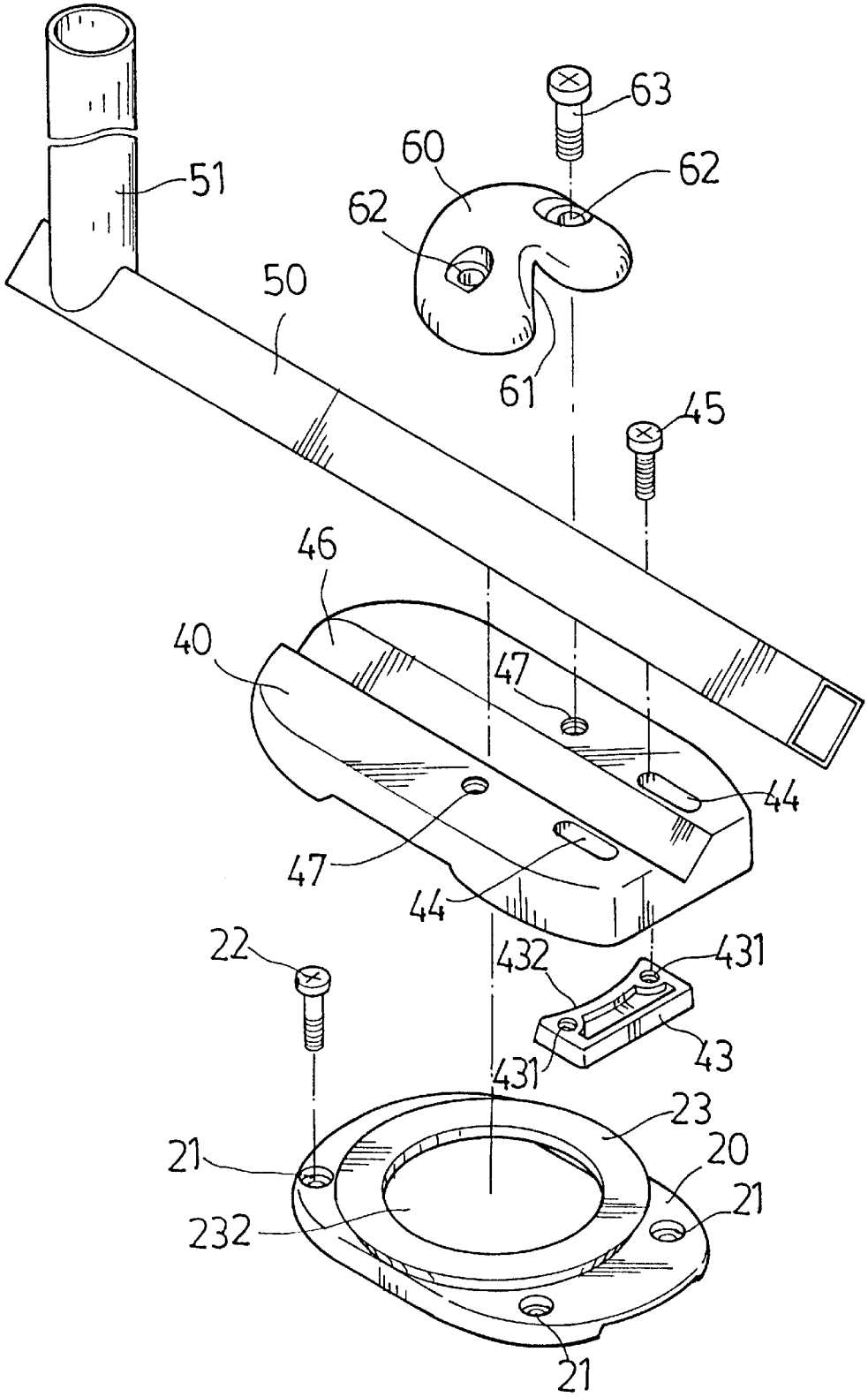
FIG. 3 is an exploded view of a tom-tom holder according to the present invention.

Referring to FIGS. 3, an adjustable tom-tom holder in accordance with the present invention is generally comprised of a mounting base 20, a swivel holder block 40, a support bar 50, a guide plate 43, and a holding down plate 60.

Figure 4:
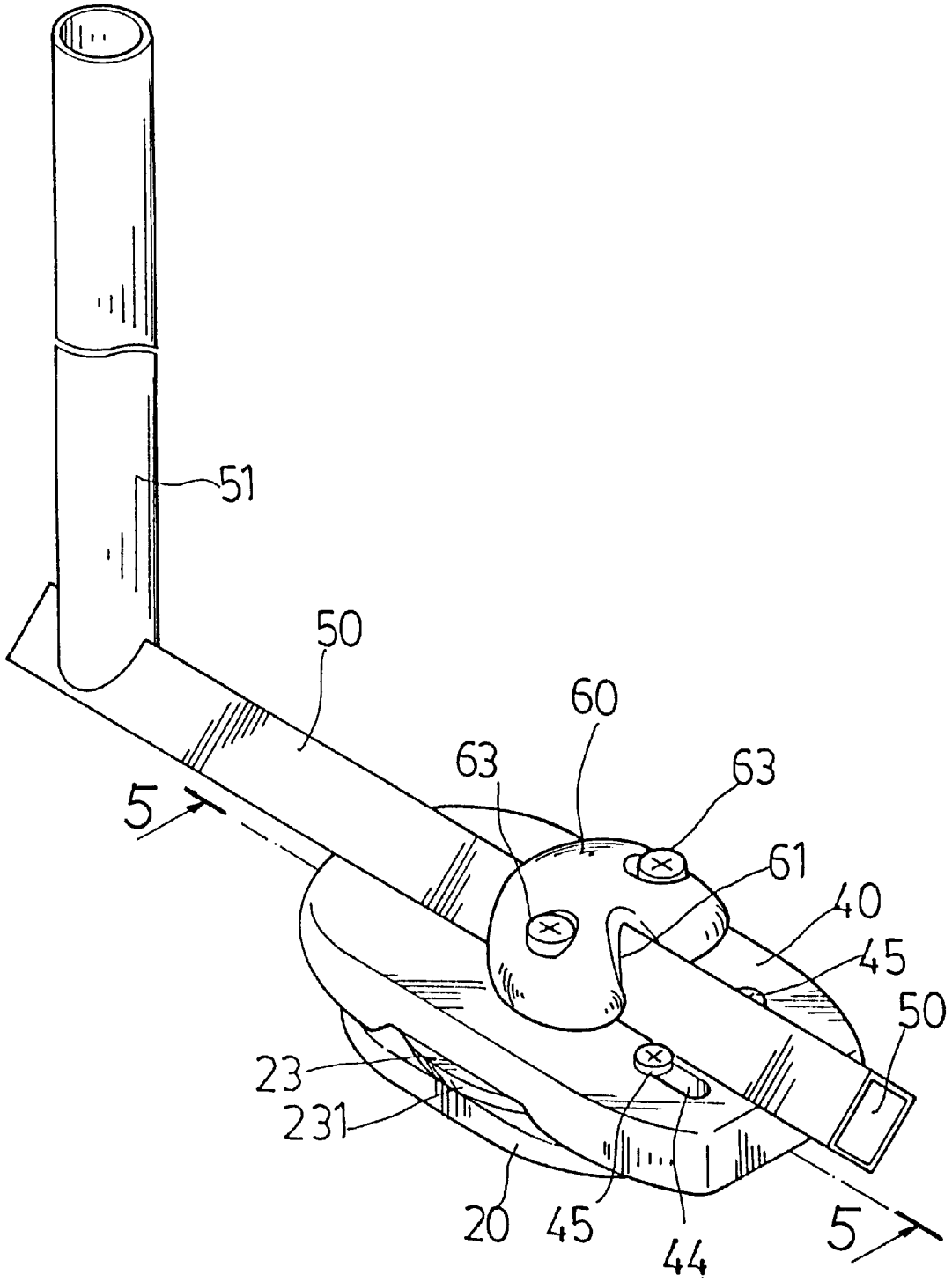
FIG. 4 is an assembly view of the tom-tom holder shown in FIG. 3.
Figure 5:
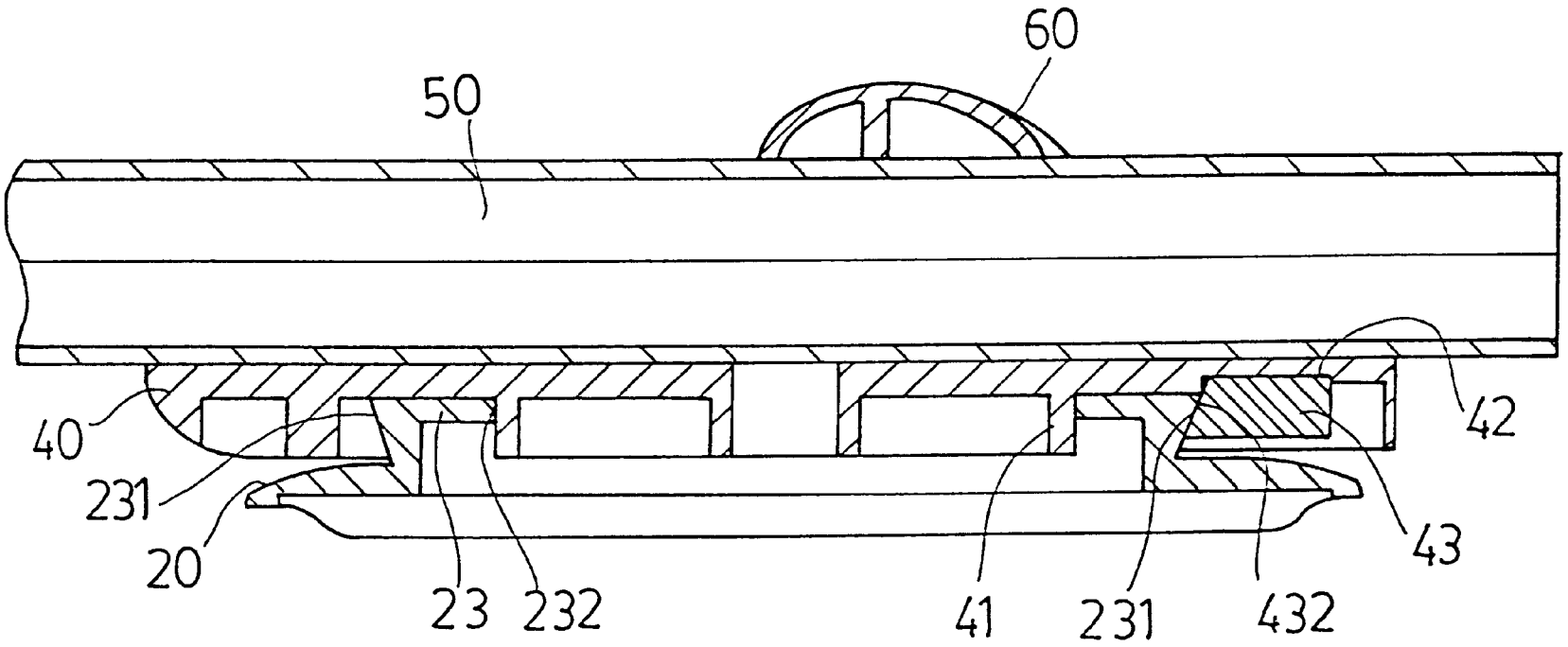
FIG. 5 is a sectional view in an enlarged scale taken along line 5—5 of FIG. 4.
Figure 6:
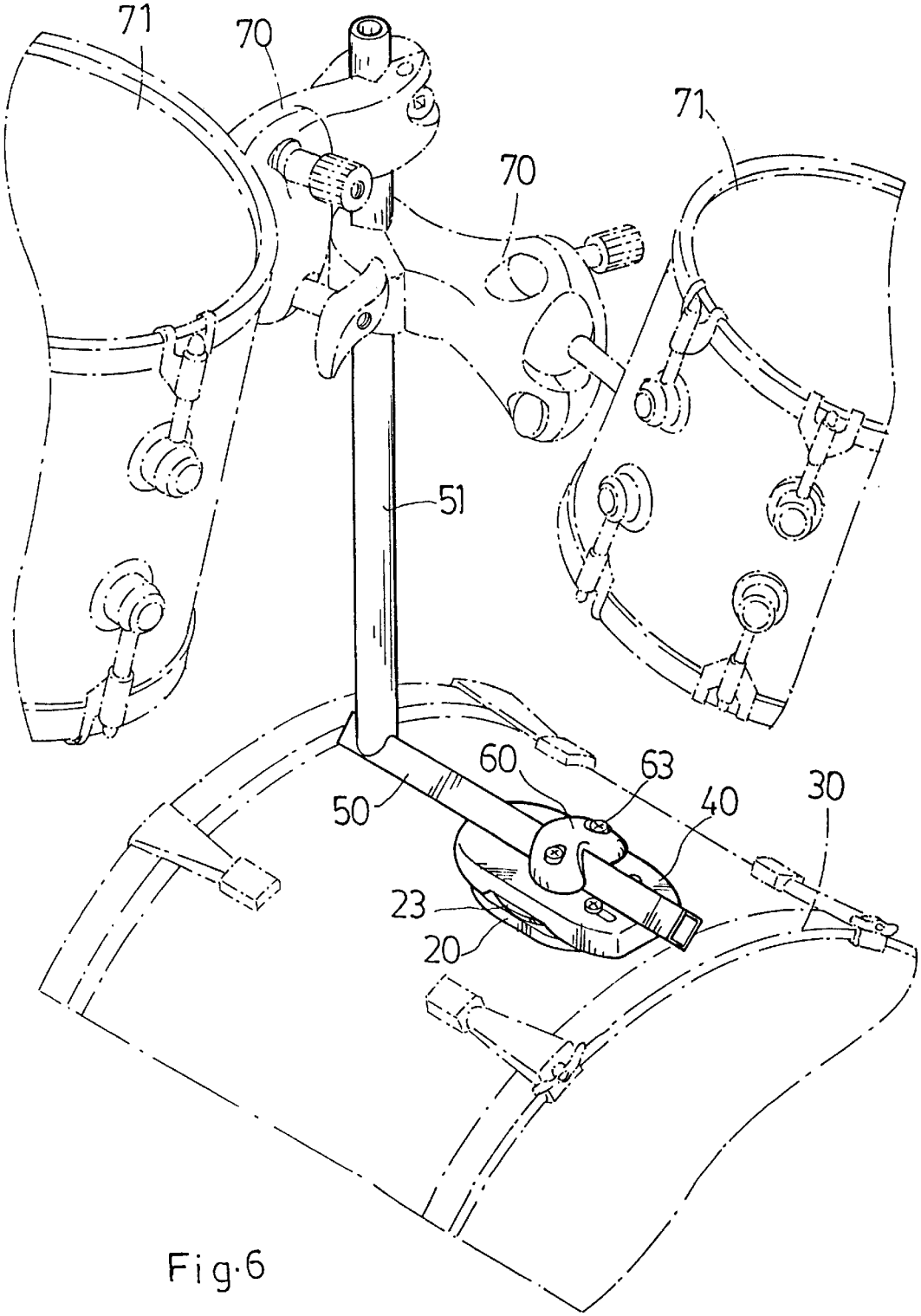
FIG. 6 is an applied view of the present invention showing the tom-tom holder installed in a base drum.

Referring to FIGS. 4, 5 and 6 and FIG. 3 again, the mounting base 20 comprises a smoothly curved bottom side wall fitting the curvature of the shell of a base drum 30 (see FIG. 6), a plurality of countersunk holes 21 spaced around the border and respectively fastened to the shell of the base drum 30 by for example screws 22, an annular coupling block 23 raised from the top side wall thereof, and a coupling hole 232 defined within the annular coupling block 23. The annular coupling block 23 has a tapered outside wall 231. The diameter of the tapered outside wall 231 gradually reduces from the topmost edge of the annular coupling block 23 to the top side wall of the mounting base 20.

The guide plate 43 comprises two mounting holes 431 near two opposite ends thereof, and a smoothly curved front sloping edge 432 fitting the tapered outside wall 231 of the annular coupling block 23 of the mounting base 20. The holder block 40 is a flat, oval block comprising an annular coupling portion 41 raised from the bottom side wall thereof, which is inserted into the coupling hole 232 in the annular coupling block 23 of the mounting base 20 for permitting the holder block 40 to be rotated in the annular coupling block 23, a bottom open chamber 42, which receives the guide plate 43, a longitudinal V-groove 46 at the top side wall thereof on the middle, two elongated slots 44 longitudinally disposed at two opposite sides of the V-groove 46 near one end in communication with the bottom open chamber 42, two fastening elements for example screws 45 respectively mounted in the elongated slots 44 and fastened to the mounting holes 431 to secure the guide plate 43 to the holder block 40 inside the bottom open chamber 42, and two mounting holes 47 spaced by the V-groove 46 and respectively disposed in front of the elongated slots 44. When assembled, the smoothly curved front sloping edge 432 of the guide plate 43 is maintained in contact with the tapered outside wall 231 of the annular coupling block 23 of the mounting base 20, enabling the holder block 40 to be smoothly turned about the annular coupling block 23 of the mounting base 20. When the screws 45 are loosened, the locating block 43 can be moved forwards/backwards in the bottom chamber 42 relative to the annular coupling block 23 of the mounting base 20 to adjust the tightness of the engagement between the smoothly curved front sloping edge 432 of the guide plate 43 and the tapered outside wall 231 of the annular coupling block 23. The support bar 50 is a non-circular bar mounted in the V-groove 46 at the holder block 40 and secured in place by the holding-down plate 60, having an upright supporting rod 51 perpendicularly raised from one end thereof. The bottom side of the support bar 50 fits the cross section of the V-groove 46. When the support bar 50 is mounted in the V-groove 46 and secured in place by the holding-down plate 60, it is stopped from rotary motion. The holding-down plate 60 comprises a bottom groove 61 fitting the top side of the support bar 50, two countersunk holes 62 disposed at two opposite sides of the bottom groove 61 and respectively fastened to the mounting holes 47 on the holder block 40 by for example screws 63.

Figure 7:
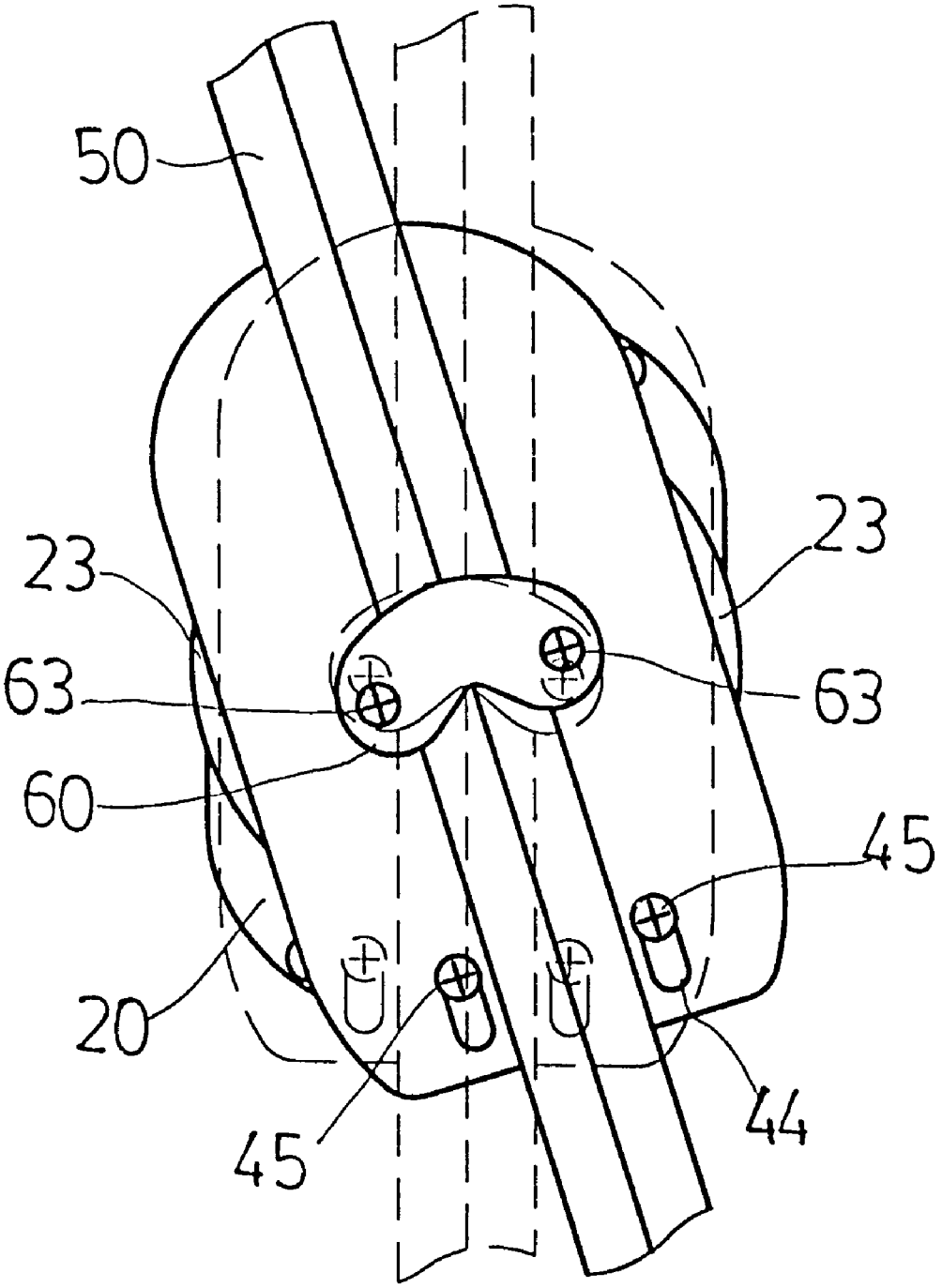
FIG. 7 is a schematic drawing showing the holder block turned about the annular coupling block of the mounting base according to the present invention.

Referring to FIGS. 6 and 7, side drums (tom-toms) 71 are fastened to the upright supporting rod 51 of the support bar 50 by mounting assemblies 70. The side drums 71 are respectively fastened to the mounting assemblies 70 by a ball and socket joint therefore the side drums 71 can conveniently be adjusted to the desired angle. The mounting base 20 is fixedly fastened to the shell of the base drum 30. The holder block 40 and the guide plate 43 are respectively coupled to the annular coupling block 23 of the mounting base 20. The holding-down plate 60 is fastened to the holder block 40 to secure the support bar 50 to the V-groove 46. When the screws 63 are loosened, the support bar 50 can be moved forwards/backwards along the V-groove 46 to the desired location. Further, the holder block 40 can be turned about the annular coupling block 23 of the mounting base 20 by hand to the desired angle. Because the smoothly curved front sloping edge 432 of the guide plate 43 is maintained in close contact with the tapered outside wall 231 of the annular coupling block 23, the holder block 40 can be turned about the annular coupling block 23 smoothly.

What I claim is:

1. An adjustable tom-tom holder comprising:

a mounting base fixedly fastened to the shell of a base drum, said mounting base comprising an annular coupling block raised from a top side wall thereof, and a coupling hole defined within said annular coupling block, said annular coupling block having a tapered outside wall, said tapered outside wall having an outer diameter gradually reducing from the topmost edge thereof to the top side wall of said mounting base;

a holder block turned about the annular coupling block of said mounting base, said holder block comprising an annular coupling portion raised from a bottom side wall thereof and coupled to the coupling hole in the annular coupling block of said mounting base, and a longitudinally extended locating groove at the top side wall thereof on the middle, said locating groove having an angled cross section;

a support bar sliding in said locating groove at said holder block and secured in place by a holding-down plate, said support bar having an upright supporting rod perpendicularly raised from one end thereof for holding side drums, the cross section of said support bar having an angled lower part fitting the angled cross section of said locating groove; and a holding-down plate fastened to said holder block to secure said support bar in position, said holding-down plate having a bottom groove at a bottom side wall thereof, which receives an upper part of said support bar, and two mounting holes near two opposite ends thereof respectively fastened to said holder block by fastening means.

2. The adjustable tom-tom holder of claim 1 wherein said holder block comprises a bottom open chamber at a bottom side facing said annular coupling block of said mounting base, and two elongated slots longitudinally disposed at two opposite sides of said locating groove near one end in communication with said bottom open chamber, and a guide plate received in said bottom open chamber and disposed in contact with said annular coupling block of said mounting base, said guide plate comprising two mounting holes near two opposite ends thereof respectively fastened to said elongated slots by respective fastening elements, and a smoothly curved front sloping edge disposed in contact with the tapered outside wall of said annular coupling block of said mounting base.

* * * * *